US006394420B2

(12) United States Patent
Kiviniitty

(10) Patent No.: US 6,394,420 B2
(45) Date of Patent: May 28, 2002

(54) AXIAL SUPPORT OF WINDING DRUM IN HOISTING APPARATUS

(75) Inventor: Ari Kiviniitty, Hämeenlinna (FI)

(73) Assignee: KCI Konecranes International PLC, Hyvinkää (FI)

( * ) Notice: Subject to any disclaimer, the term of this patent is extended or adjusted under 35 U.S.C. 154(b) by 0 days.

(21) Appl. No.: 09/758,370

(22) Filed: Jan. 12, 2001

(30) Foreign Application Priority Data

Jan. 14, 2000 (FI) ..... 000075

(51) Int. Cl.[7] ..... B66D 1/00
(52) U.S. Cl. ..... 254/333
(58) Field of Search ..... 254/278, 332, 254/333, 374, 385, 371

(56) References Cited

U.S. PATENT DOCUMENTS

| | | | | | |
|---|---|---|---|---|---|
| 1,550,114 | A | * | 8/1925 | Simpson | 254/333 |
| 1,572,001 | A | * | 2/1926 | Dotzert | 254/333 |
| 2,625,373 | A | * | 1/1953 | Hunt | 254/333 |
| 3,042,375 | A | * | 7/1962 | Fahey et al. | 254/333 |
| 3,048,370 | A | * | 8/1962 | Kratzer | 254/333 |
| 3,306,553 | A | | 2/1967 | Mansell | |
| 3,477,316 | A | | 11/1969 | Wildhaber | |
| 4,003,552 | A | * | 1/1977 | Sobolewski | 254/374 |
| 4,042,214 | A | | 8/1977 | Brener | |
| 4,458,882 | A | * | 7/1984 | Schorling | 254/332 |
| 5,829,737 | A | * | 11/1998 | Gersemsky | 254/278 |
| 6,247,680 | B1 | * | 6/2001 | Cohen | 254/333 |

FOREIGN PATENT DOCUMENTS

| | | |
|---|---|---|
| DE | 261238 | 1/1912 |
| DE | 800246 | 9/1950 |
| DE | 816737 | 8/1951 |
| DE | 1826363 | 2/1961 |
| DE | 2425433 | 12/1975 |
| DE | 2433715 | 1/1976 |
| DE | 2740005 | 3/1979 |
| GB | 753569 | 7/1956 |
| SE | 38386 | 12/1912 |

* cited by examiner

*Primary Examiner*—Emmanuel M. Marcelo
(74) *Attorney, Agent, or Firm*—Birch, Stewart, Kolasch & Birch, LLP

(57) ABSTRACT

An axial support of a winding drum, i.e. a support in the direction of the longitudinal axis of the winding drum, in a hoisting apparatus comprising a frame, a grooved winding drum supported substantially perpendicular to its longitudinal axis against the frame by bearings, a hoisting rope and machinery. The winding drum comprises at least one axial support element and the frame comprises at least another axial support element, and at least either the axial support element of the winding drum or the axial support element of the frame substantially extends round the circumference of the winding drum. The axial support element of the winding drum and the axial support element of the frame are arranged in respect of each other such that the movement of the winding drum in the direction of its longitudinal axis, which is caused by the axial component of the rope force of the hoisting rope, is hindered at least in one direction.

12 Claims, 2 Drawing Sheets

AXIAL SUPPORT OF WINDING DRUM IN HOISTING APPARATUS

BACKGROUND OF THE INVENTION

1. Field of the Invention

The invention relates to an axial support of a winding drum in a hoisting apparatus comprising a frame, a grooved winding drum supported substantially perpendicular to its longitudinal axis against the frame by bearings, a hoisting rope and machinery, the winding drum comprising at least one axial support element close to the circumference of the winding drum and the frame comprising at least one axial support element close to the circumference of the winding drum.

2. Description of the Prior Art

A hoisting apparatus intended for moving a load vertically is usually a part of either a fixed rope hoist or a rope hoist which can be moved along a track by means of a trolley. The hoisting apparatus can also be used as such for hoisting a load. The hoisting apparatus comprises a winding drum which, by utilizing rotating motion, winds a hoisting rope used as hoisting means on or off the winding drum, whereby the position of the load fastened to the hoisting rope by means of a hook can be controlled in respect of the hoisting apparatus. On the surface of the winding drum there is a groove with a pitch, and when the winding drum rotates, the hoisting rope is guided to this groove. The winding drum is typically rotated by machinery which consists of a motor and a gear. The winding drum is supported by bearings to the frame of the hoisting apparatus. The purpose of this support is to expose the frame of the hoisting apparatus to rope force caused by the load. Rope force can be divided into two main components. The stronger one of the components, i.e. a vertical component, has a perpendicular effect in respect of the longitudinal axis of the winding drum and the weaker component, i.e. an axial component, is parallel to the longitudinal axis of the winding drum. The axial component of the rope force is caused by the angle formed by the hoisting rope and the longitudinal axis of the winding drum. The axial component of the rope force causes that in the direction of its longitudinal direction, the winding drum is eccentric in respect of the frame of the hoisting apparatus, which additionally stresses the bearings of the winding drum and complicates the optimization of the bearing structures of the rope hoist.

A known solution to support a winding drum axially, i.e. in the direction of the longitudinal axis of the winding drum, is to provide the winding drum with a central axis by which the winding drum is axially pivoted by a bearing supporting the load at least from one end of the winding drum to the frame of the hoisting apparatus. According to the solution, the central axis is provided with ball bearings, and retaining rings and a collar of the axis are used for locking the winding drum in the direction of its longitudinal axis. The problem is, however, that because of the bearings at least one end of the winding drum is closed, wherefore the interior of the hollow winding drum cannot be efficiently utilized and, for example, the machinery cannot be placed inside the winding drum.

Another known solution to support the winding drum axially is to form a bearing surface onto the frame of the hoisting apparatus, the bearing surface being placed against the end surface of the winding drum. The problem of this solution is that it requires more space in the longitudinal direction of the winding drum and that it is difficult to check and replace the bearing surface. This type of support is known from the publications DE-816737 and DE800246, for example.

The publications DE-261238 and SE-38386 disclose a hoist comprising a winding drum at both ends of which there is a protrusion on the outer circumference of the winding drum, the protrusion extending round the entire circumference of the winding drum and forming one edge for the space intended for bearing balls of the winding drum. The other edge for the space intended for bearing balls is formed by a ring in connection with the frame and extending round the entire circumference of the winding drum. In these publications, the axial movement of the winding drum is restricted by the protrusion on the outer circumference of the winding drum, the bearings of the winding drum and the ring in connection with the frame. A drawback of the solution is, for example, that the elements implementing the axial support for the winding drum have to extend round the entire circumference of the winding drum, which increases the costs of the solution. Furthermore, since the bearings of the winding drum are a part of the axial support of the winding drum, the rotational movement of the winding drum is impaired and the bearings may become damaged.

BRIEF SUMMARY OF THE INVENTION

It is an object of the present invention to provide a simple axial support for a winding drum, the support being easy to make.

According to the invention, the axial support of the winding drum in the hoisting apparatus is characterized in that at least one axial support element of the winding drum or at least one axial support element of the frame is discontinuous in the circumferential direction of the winding drum and that the axial support element of the winding drum and the axial support element of the frame are arranged in respect of each other such that the movement of the winding drum in the direction of its longitudinal axis, which is caused by an axial component of the rope force of the hoisting rope, is hindered at least in one direction.

The essential idea of the invention is that in a hoisting apparatus intended for moving a load vertically and comprising a frame, a grooved winding drum supported to the frame by bearings substantially perpendicular to the longitudinal axis of the winding drum, a hoisting rope and machinery, the movement of the winding drum in the direction of the longitudinal axis, which is caused by the axial component, i.e. the component parallel to the longitudinal axis of the winding drum, of the rope force of the hoisting rope, is hindered at least in one direction such that there is at least one axial support element close to the circumference of the winding drum and that there is at least one axial support element in the frame, close to the circumference of the winding drum, and at least either the axial support element of the winding drum or the axial support element of the frame substantially extends round the circumference of the winding drum, and that the axial support element of the winding drum and the axial support element of the frame are arranged in respect of each other such that the winding drum cannot move in the direction of its longitudinal axis. According to a preferred embodiment of the invention, the axial support element of the winding drum is placed onto the outer surface of the winding drum. According to another preferred embodiment of the invention, the axial support element of the frame is arranged in the circumferential direction of the winding drum substantially at the same level at which the hoisting rope comes into contact with the winding drum, when it either leaves or reaches the winding drum. According to a third preferred embodiment of the invention, the length of either the axial support element of the winding drum or the axial support element of the frame in the circumferential direction of the winding drum is substantially shorter than the length of the winding drum circumference.

The invention provides the advantage that the axial support of the winding drum has a simple structure which is easy to check and service. Furthermore, the structure does not require space outside the winding drum in the longitudinal direction. When the axial support element of the winding drum is placed at such a place on the outer surface of the winding drum where grooves for the rope cannot be made, the axial support element does not affect the length of the winding drum either. By placing the axial support element of the winding drum onto the inner surface of the winding drum, the length of the winding drum can be minimized. When the axial support element of the frame is arranged in the circumferential direction of the winding drum-at the same level at which the hoisting rope comes into contact with the winding drum, when either leaving or reaching the winding drum, the frame of the hoisting apparatus can be directly subjected to the axial component of the rope force. When the length of either the axial support element of the winding drum or the axial support element of the frame is substantially shorter in the circumferential direction of the winding drum than the length of the winding drum circumference, the axial support element can be checked and replaced easily. By arranging one or more axial support elements of the winding drum at both ends of the winding drum and forming axial support elements at the frame, corresponding to the axial support elements of the winding drum, the forces caused by the axial component of the rope force of the hoisting rope can be distributed more evenly to the frame, which further makes it possible to optimize the supporting structures of the rope hoist.

Further scope of the applicability of the present invention will become apparent from the detailed desription given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
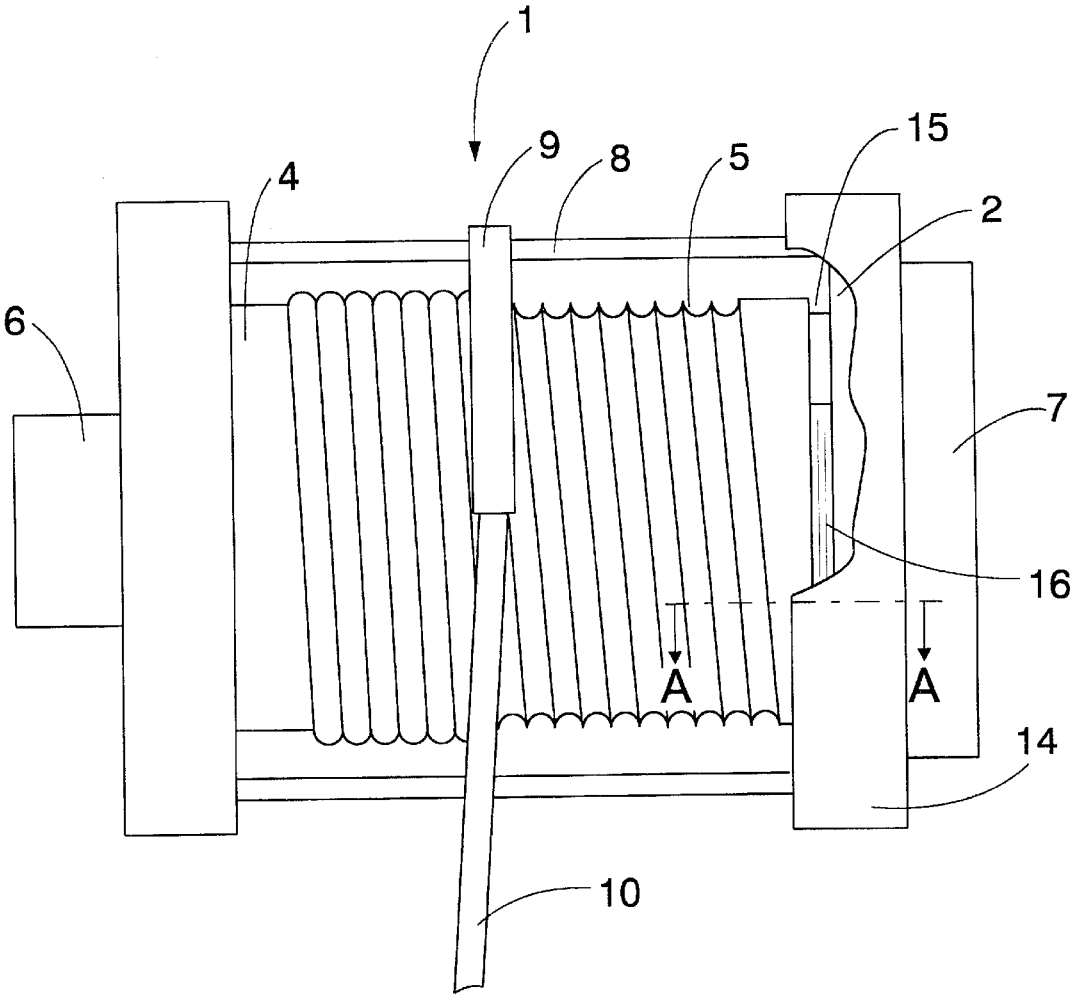
FIG. 1 schematically shows a partly sectional side view of an embodiment of a support according to the invention.

FIG. 1 schematically shows a partly sectional side view of an axial support of a winding drum 4 in a hoisting apparatus 1, i.e. a support in the direction of the longitudinal axis of the winding drum 4. On the surface of the winding drum 4 of the hoisting apparatus 1 shown in FIG. 1 there is a rope groove 5 with a pitch. The winding drum 4 is supported by bearings 3 to the frame 2 of the hoisting apparatus 1, as in FIG. 3. The hoisting apparatus 1 further comprises machinery for rotating the winding drum 4, the machinery consisting of a hoisting motor 6 and a gear system 7 or a gear 7. The machinery can also comprise only a hoisting motor 6. In FIG. 1, the hoisting motor 6 is placed partly inside the winding drum 4, but the location of the hoisting motor 6 in respect of the winding drum 4 can vary. The hoisting apparatus 1 comprises an auxiliary frame 8 at which a rope guide 9 moving in the longitudinal direction of the winding drum 4 is arranged, the rope guide guiding a hoisting rope 10 or other similar hoisting means into the groove 5 of the winding drum 4. Under the end cover 14 of the hoisting apparatus 1, shown in FIG. 1 partly in section, there is an axial support element according to the invention, which is formed at the right end of the winding drum 4 and which, in this case, is a groove 15 machined onto the outer surface of the winding drum 4, and there is also an axial support element of the frame 2 of the hoisting apparatus 1, which support element is to be arranged in respect of the axial support element of the winding drum 4 and which, in this case, is a bearing element 16 that is set to the groove 15. In the embodiment according to FIG. 1, the groove 15 and the bearing element 16 form an axial support for the winding drum 4, the support being shown more specifically as a schematic cross-section along the line A—A in FIG. 3.

Figure 2:
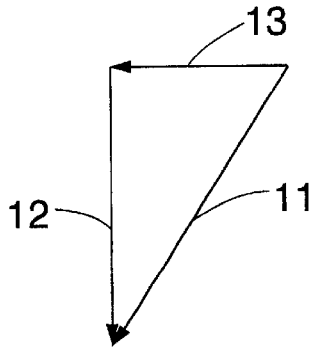
FIG. 2 is a schematic view of force components of the rope force, to which the embodiment according to FIG. 1 is subjected.

FIG. 2 is a schematic view of force components of the rope force, caused by the load of the hoisting apparatus 1 to the hoisting rope 9, the load being not shown in FIG. 1 for the sake of clarity. The resultant 11 of the rope force is formed of a vertical component 12 that has a perpendicularly downwards directed effect in respect of the longitudinal axis of the winding drum 4 and an axial component 13 parallel to the longitudinal axis of the winding drum 4. Compared to FIG. 11 in order to illustrate the axial component 13 of the rope force FIG. 2 emphasizes the angle formed by the hoisting rope 10 and the longitudinal axis of the winding drum 4, which means that the resultant 11 of the rope force is directed to the left more than the angle formed by the winding drum and the hoisting rope 10 in FIG. 1 would require. The application point of the rope force is at that level of the winding drum 4 where the hoisting rope 10 leaves the winding drum 4. In FIGS. 1 and 2, the axial component 13 of the rope force affects from right to left, but depending on the angle formed by the hoisting rope 10 and the winding drum, the axial component 13 can affect from left to right, whereby the direction of the rope force resultant 11 also changes to conform to this situation.

Figure 3:
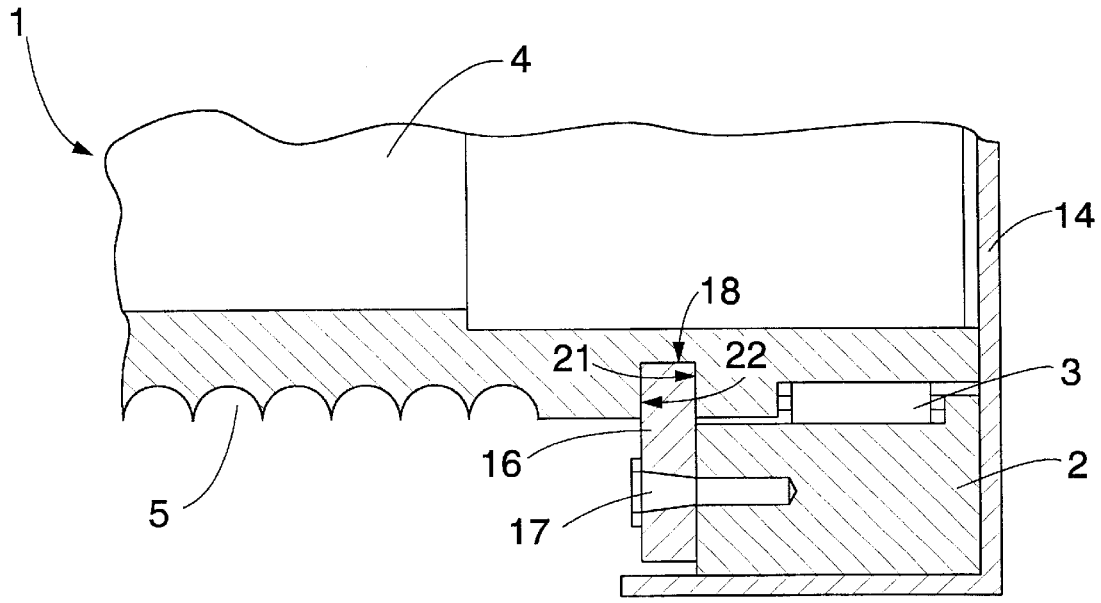
FIG. 3 is a schematic cross-sectional side view of a detail of the support according to FIG. 1.

FIG. 3 shows a detail of the axial support of the winding drum 4 according to FIG. 1 in cross-section along the line A—A shown in FIG. 1. FIG. 3 also shows the bearings 3 on the outer circumference of the winding drum 4, the bearings supporting the winding drum substantially perpendicular to its longitudinal axis against the frame 2 of the hoisting apparatus 1. In accordance with the invention, the outer surface of the winding drum 4 is provided with a groove 15 which extends round the entire circumference of the winding drum 4 and has a rectangular cross-section. The edge 18 of the preferably planar or flange-like bearing element 16 that has a rectangular cross-section and is fixed to the frame 2 by a bolt 17 is set between edges 21 and 22 of the groove 15. The length of the bearing element 16 in the circumferential direction of the winding drum 4 is dimensioned such that the bearing element 16 is substantially shorter than the length of the winding drum 4 circumference, whereby it is easy to replace and check the bearing element. In the circumferential direction of the winding drum 4 the bearing element 16 can thus be a short flange, but the bearing element 16 can also be a pin or a similar element. A preferable location of the bearing element 16 in the frame 2 is in the circumferential direction of the winding drum 4 substantially at the same level at which the hoisting rope 10 comes into contact with the winding drum 4 when the hoisting rope 10 either leaves or reaches the winding drum 4. Thus the axial component 13 of the rope force can be directly applied to the frame 2 of the hoisting apparatus 1. However, there can also be more than one bearing element 16 attached to the frame 2 such that their total length in the circumferential direction of the winding drum 4 is smaller than the length of the winding drum 4 circumference. The shape of the cross-section of the groove 15 can be selected very freely, but preferably the groove 15 has a rectangular cross-section. The shape of the cross-section of the bearing element 16, in turn, follows the shape of the cross-section of the groove 15. The shape of the bearing element 16 edge 18 that is set to the groove 15, i.e. the radius of the bearing element 16, corresponds to the radius of the circumference of the groove 15 bottom. In this embodiment of the invention, the groove 15 thus forms the axial support element for the winding drum 4, i.e. the first axial support element, and the bearing element 16 forms the axial support element for the frame 2 of the hoisting apparatus 1, i.e. the second axial support element.

The axial support of the winding drum 4, as shown in FIGS. 1 and 3, not only prevents the movement of the winding drum 4 to the left, which is caused by the axial component 13 of the rope force shown in FIG. 2 and directed to the left, but it also prevents the movement of the winding drum 4 to the right, caused by the axial component possibly directed from left to right. Thus, the axial support according to FIGS. 1 and 3, which is only implemented at one end of the winding drum 4, is perfectly sufficient for hindering the winding drum 4 from moving in the direction of its longitudinal axis 4. The axial support of the winding drum 4, as shown in FIGS. 1 and 3, can also be implemented at both ends of the winding drum 4, whereby the axial component 13 of the rope force, which is applied to the frame 2 of the hoisting apparatus 1 via the support, is more evenly distributed to the frame 2, which enables the optimization of the support structures of the rope hoist.

The bearing element 16 is made of a bearing material, for example bearing metal, such as bronze, or bearing plastic, such as polytetrafluoroethylene. Although in FIG. 3 the bearing element 16 is fixed by the bolt 17 to the frame 2, also some other similar fixing element or fixing means can be used instead of the bolt 17. Furthermore, it is perfectly clear that the bearing element 16 can be formed of several separate elements, but preferably it is made of one uniform section.

The axial support shown in FIGS. 1 and 3 can also be implemented such that the bearing element 16 is formed at the winding drum 4 to replace the groove 15 and that the groove 15 is formed onto the frame 2 of the hoisting apparatus 1 to replace the bearing element 16 such that the edge 18 of the bearing element 16 of the winding drum 4 is set between the edges of the groove 15 of the frame 2. In this embodiment, the bearing element 16 at the winding drum 4 and the groove 15 in the frame 2 can both extend substantially round the entire circumference of the winding drum 4. Thus the bearing element 16 can be made for example of two connectable sections that are arranged onto the outer surface of the winding drum 4. The function of the support is entirely similar to the support according to FIGS. 1 and 3.

Figure 4:
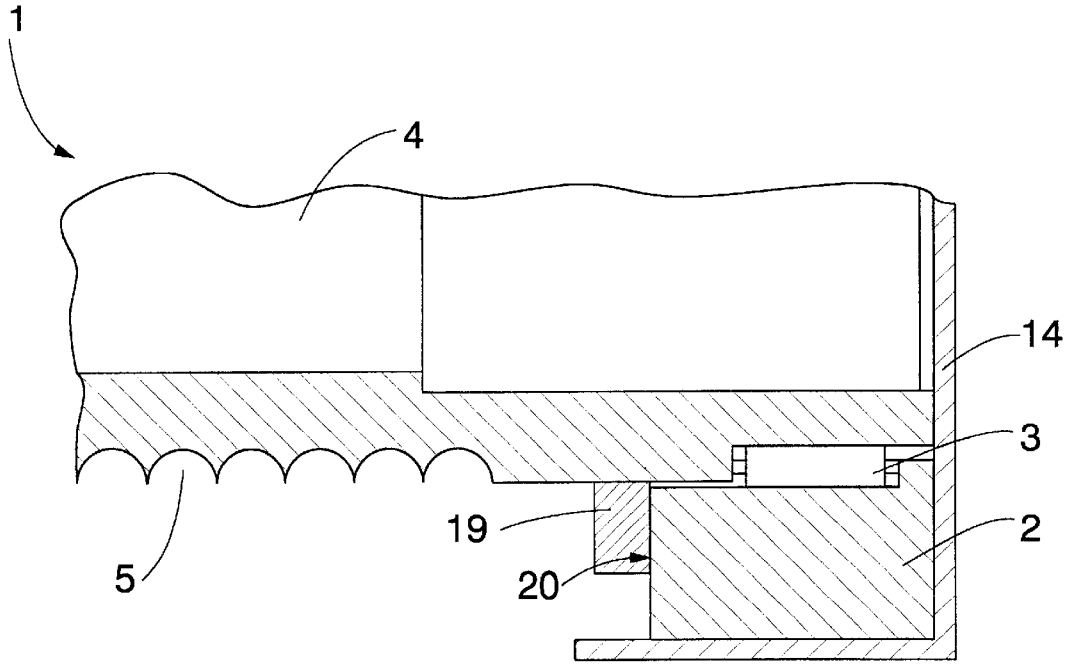
FIG. 4 is a schematic cross-sectional side view of a detail of another support embodiment according to the invention.

FIG. 4 is a schematic, partly cross-sectional side view of a detail of another support according to the invention. In the embodiment according to FIG. 4 there is a flange 19 on the outer surface of the winding drum 4 and the frame 2 is provided with a bearing surface 20 against which the flange 19 of the winding drum 4 rests and thereby hinders the winding drum 4 from moving to the right in FIG. 4 when the axial component 13 of the rope force is directed from left to right. The flange 19 is substantially shorter than the length of the winding drum 4 circumference, and the bearing surface 20 of the frame 2 extends round the entire circumference of the winding drum 4. The flange 19 may be, for example, an attachment element of the hoisting rope 10, by which the hoisting rope 10 is attached to the winding drum 4. Instead of the flange 19, simply a pin or a similar object can be used. Since the support of FIG. 4 supports the winding drum 4 in the direction of its longitudinal axis only in one direction, i.e. against the axial-component 13 of the rope force which is directed from left to right, a corresponding flange 19 has to be formed at the other end of the winding drum 4, this flange supporting the winding drum 4 while the axial component 13 of the rope force is directed from right to left. The embodiment according to FIG. 4 can also be implemented such that the bearing surface 20 of the frame 2 is discontinuous in the circumferential direction of the winding drum 4 and the flange 19 of the winding drum 4 extends entirely round the winding drum 4 circumference.

The drawings and the related description are only intended to illustrate the idea of the invention. In its details, the invention may vary within the scope of the claims. A preferable location of the groove 15 is on the outer surface of the winding drum 4, but the groove 15 can also be arranged onto the inner surface of the winding drum 4, in which case the supporting structures of the hoisting apparatus I are designed in such a manner that at least one bearing element 16 can be attached inside the winding drum 4 to the supporting structures. Similarly the bearing element 16 or the flange 19 can be placed onto the inner surface of the winding drum 4 and the supporting structures of the hoisting apparatus 1 are designed in such a manner that at least one groove 15 or bearing surface 20 can be formed inside the winding drum 4. The axial support inside the winding drum 4 enables that the length of the winding drum 4 can be minimized. Regardless of whether the groove 15 is formed at the winding drum 4 or the frame 2 inside or outside the winding drum 4, bearings can be arranged at the bottom of the groove 15 between the groove 15 bottom and the bearing element 16. A bearing that is directly or indirectly supported to the frame 2, or a pivoted wheel that rolls in the groove 15 on the outer or inner surface of the winding drum 4 can also be used as a bearing element 16. Both the axial support element of the winding drum 4 and the axial support element of the frame 2 of the hoisting apparatus 1 can also extend round the winding drum 4 circumference, but preferably only the axial support element of the winding drum 4 or the axial support element of the frame 2 extends round the entire circumference of the winding drum 4, which means that at least either the axial support element of the winding drum 4 or the axial support element of the frame 2 is discontinuous in the circumferential direction of the winding drum 4. Furthermore, in accordance with the invention the axial support of the winding drum 4 can be implemented in the direction of the longitudinal axis of the winding drum 4 on the area that is outside the bearings 3 or bearing points 3 of the winding drum 4, but preferably the axial support is implemented on the area between the bearings 3 of the winding drum 4, in which case the length of the winding drum 4 can be minimized.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An axial support of a winding drum in a hoisting apparatus comprising a frame, a grooved winding drum supported substantially perpendicular to its longitudinal axis against the frame by bearings, a hoisting rope and machinery, the winding drum comprising at least one axial support element close to the circumference of the winding drum and the frame comprising at least one axial support element close to the circumference of the winding drum, wherein at least one axial support element of the winding drum or at least one axial support element of the frame is discontinuous in the circumferential direction of the winding drum and the axial support element of the winding drum and the axial support element of the frame are arranged in respect of each other such that the movement of the winding drum in the direction of its longitudinal axis, which is caused by an axial component of the rope force of the hoisting rope, is hindered at least in one direction.

2. The axial support as claimed in claim 1, wherein the bearings supporting the winding drum to the frame substantially perpendicular to the longitudinal axis are on the outer circumference of the winding drum.

3. The axial support as claimed in claim 1, wherein the axial support element of the winding drum is a groove and the axial support element of the frame is a bearing element or a pin.

4. The axial support as claimed in claim 1, wherein the axial support element of the winding drum is a flange or a pin and the axial support element of the frame is a surface.

5. The axial support as claimed in claim 4, wherein the axial support element of the winding drum is made of a bearing material.

6. The axial support as claimed in claim 1, wherein the axial support element of the frame is made of a bearing material.

7. The axial support as claimed in claim 6, wherein the bearing material is bronze or polytetrafluoroethylene.

8. The axial support as claimed in claim 1, wherein the axial support element of the winding drum is a groove and the axial support element of the frame is a bearing or a pivoted wheel.

9. The axial support as claimed in claim 1, wherein the axial support element of the frame is in the circumferential direction of the winding drum substantially at the same level at which the hoisting rope comes into contact with the winding drum when the hoisting rope leaves or reaches the winding drum.

10. The axial support as claimed in claim 1, wherein the axial support element of the winding drum is a bearing element or a pin and the axial support element of the frame is a groove.

11. The axial support as claimed in claim 1, wherein the axial support of the winding drum is in the direction of the longitudinal axis of the winding drum on the area between the bearings of the winding drum.

12. The axial support as claimed in claim 1, wherein the axial support element of the winding drum is on the outer surface of the winding drum.

* * * * *

UNITED STATES PATENT AND TRADEMARK OFFICE

CERTIFICATE OF CORRECTION

PATENT NO. : 6,394,420 B2
DATED : May 28, 2002
INVENTOR(S) : Ari Kiviniitty

It is certified that error appears in the above-identified patent and that said Letters Patent is hereby corrected as shown below:

Title page,
Item [30], Foreign Application Priority Data, please change the Finnish application number from "000075" to -- 20000075 --.

Signed and Sealed this

Seventeenth Day of June, 2003

JAMES E. ROGAN
*Director of the United States Patent and Trademark Office*